US008444344B2

(12) United States Patent
Oesterberg et al.

(10) Patent No.: US 8,444,344 B2
(45) Date of Patent: May 21, 2013

(54) TEMPORARY CONTAINMENT OF OIL WELLS TO PREVENT ENVIRONMENTAL DAMAGE

(75) Inventors: Marcus Oesterberg, Kingwood, TX (US); Roger W. Fincher, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 426 days.

(21) Appl. No.: 12/898,904

(22) Filed: Oct. 6, 2010

(65) Prior Publication Data

US 2012/0087729 A1 Apr. 12, 2012

(51) Int. Cl.
*E21B 33/035* (2006.01)
*E21B 43/013* (2006.01)

(52) U.S. Cl.
USPC ..... 405/60; 166/364

(58) Field of Classification Search
USPC ..... 405/60; 166/363, 357, 356, 75.13, 166/367, 364, 368
See application file for complete search history.

(56) References Cited

U.S. PATENT DOCUMENTS 1,858,241 A * 5/1932 Giles ..... 166/95.1
1,859,606 A * 5/1932 Fredrick et al. ..... 166/79.1
3,745,773 A * 7/1973 Cunningham ..... 405/60
4,318,442 A * 3/1982 Lunde et al. ..... 166/357
4,323,118 A * 4/1982 Bergmann ..... 166/96.1
4,358,218 A * 11/1982 Graham ..... 405/60
4,416,565 A * 11/1983 Ostlund ..... 210/170.11
4,440,523 A * 4/1984 Milgram et al. ..... 210/170.11
4,456,071 A * 6/1984 Milgram ..... 166/356
4,568,220 A * 2/1986 Hickey ..... 405/60
5,107,931 A * 4/1992 Valka et al. ..... 166/342
6,176,317 B1 1/2001 Sepich ..... 166/379
6,415,877 B1 7/2002 Fincher et al. ..... 175/5
6,615,923 B1 9/2003 Lay, Jr. et al. ..... 166/368
6,648,081 B2 11/2003 Fincher et al. ..... 175/25
6,719,496 B1 4/2004 Von Eberstein ..... 405/224
6,817,417 B2 * 11/2004 Blair et al. ..... 166/335
6,845,815 B2 1/2005 Hergarden et al. ..... 166/92.1
6,854,532 B2 2/2005 Fincher et al. ..... 175/5
7,051,804 B1 5/2006 Arning ..... 166/97.1
7,600,571 B2 10/2009 Smith ..... 166/379
7,987,903 B1 * 8/2011 Prado Garcia ..... 166/75.13
8,322,437 B2 * 12/2012 Brey ..... 166/363
2003/0146000 A1 8/2003 Dezen et al. ..... 166/368
2007/0034379 A1 2/2007 Fenton et al. ..... 166/368
2012/0325489 A1 * 12/2012 Beynet et al. ..... 166/353

* cited by examiner

*Primary Examiner* — Daniel P Stephenson
(74) *Attorney, Agent, or Firm* — Shawn Hunter

(57) ABSTRACT

A containment vessel is moved proximate to and preferably surrounding the wellhead, such that leaking oil enters an interior chamber of the vessel. A fluid pump of the containment system is actuated to flow leaking hydrocarbon fluid through a conduit toward a collection sump. A controller controls the speed or volume of a fluid pump to maintain suction force within the interior chamber, or the pressure at wellhead annulus site (PWAS) at a set point that is based on seabed pressure.

28 Claims, 6 Drawing Sheets

20
22
60
14
16
28
30
24
65
48
26
56
50
58
18
54
31
67
48
61
32
12
11
10

20
22
60
14
16
28
30
11
24
26
48
58
18
50
56
54
48
67
31
61
32
12
11
10

20
22
60
14
16
28
30
11
24
78
26
48
76
80
58
18
80
82
50
56
54
31'
67
48
61
32
12
11
10

TEMPORARY CONTAINMENT OF OIL WELLS TO PREVENT ENVIRONMENTAL DAMAGE

BACKGROUND OF THE INVENTION

1. Field of the Invention

The invention relates generally to subsea wellheads and techniques for containment of any leaking fluids from such wellheads.

2. Description of the Related Art

In a subsea well leak, significant amounts of crude oil, gases, salt water and other fluids may be released into the sea. Conventional techniques for responding to such leaks generally seek to install a plug or sealing cap within or upon the subsea well head or within the flowing tubular in order to close off flow of hydrocarbon fluids out of the wellbore. However, it may be difficult to install a plug or sealing cap in many situations due to the differential pressures between the wellbore pressure and the surrounding sea. In addition, the depth and remoteness of the wellhead may make it difficult to install such a plug or sealing cap effectively or in a timely manner.

SUMMARY OF THE INVENTION

The invention provides systems and methods for at least temporarily containing a subsea wellhead and controlling fluid outflow from the wellhead until a more permanent method of closing off the well can be completed. In one embodiment, the invention provides a containment system having a containment vessel that defines an interior chamber that is shaped and sized to fit over a subsea well head housing in a loose manner. The In one embodiment, the vessel generally includes three openings that provide access between the interior chamber and the exterior of the vessel. One opening interconnects the interior chamber with a riser or other deployment means, which extends to surface. A second opening interconnects the interior chamber with a flow conduit that leads to a collection sump or holding tank. In a described embodiment, the flow conduit communicates through a side wall of the containment vessel so that well fluids are flowed laterally out of the interior chamber. At least one fluid pump, such as a variable-speed centrifugal pump, is associated with the flow conduit to flow fluid from the interior chamber to the collection sump. In some embodiments, a third opening is provided in the vessel. A second flow conduit is interconnected with this third opening and is used to flow one or more chemicals, such as methanol, into the interior chamber which prevent hydrate solids or ice crystals from forming.

According to methods of operation, the containment system is assembled and launched from a rig, ship or other platform at the surface of the water. Preferably, the containment vessel is affixed to a riser and then is disposed downwardly from the platform or vessel toward the leaking wellhead. The first and second flow conduits are preferably also secured to the containment vessel and riser during running at the surface prior to launch. However, they may also be interconnected with the containment vessel at a later time using remotely operated vehicles (ROVs). Alternatively, the first and second flow conduits may be integrated into the riser. The containment vessel is moved proximate to and preferably surrounding the wellhead, such that leaking oil is released into the interior chamber of the vessel. It is not essential or even intended that the containment vessel creates a high-pressure seal with or even completely encloses the well head. Seawater inflow into the interior chamber is limited by pressure differential. The fluid pump of the containment system is then actuated to flow leaking hydrocarbon fluid through the first flow conduit and to the collection sump.

According to embodiments of the invention, a controller controls the speed or flow volume of the fluid flow device to maintain a predetermined pressure or flow/fluid interface within the interior chamber, or a pressure at the wellhead annulus site (or PWAS) based upon a set point that is at, above or below seabed pressure. The controller is used to balance fluid flow from the containment vessel with the fluid pump. In one manner of operation, the controller controls the fluid pump to maintain the pump PWAS at a set point that is at, above or below sea bed pressure. Seabed pressure may be measured by a sensor that is carried on the containment vessel or an ROV. Alternatively, seabed pressure may be calculated based upon the wellhead depth and the controller programmed with a set point based upon such calculated sea bed pressure.

In accordance with some embodiments of the invention, leaking well fluids are blocked from flow into the riser during containment by a blocking valve that is operably associated with the riser. According to one method of operation, the riser and containment vessel are disposed into the water and lowered to depth with the blocking valve open to permit fluid flow into the riser and pressure equalization. When the containment vessel is moved proximate the leaking well head, the blocking valve is then closed to prevent flow of leaking well fluids into the riser and thereby prevent an uncontrolled flow of leaking fluids up the riser toward the platform. In an alternative to the blocking valve, the riser may be pressurized from the surface to prevent leaking well fluids from flowing up the riser in an uncontrolled manner.

In alternative embodiments of the invention, fluid flow into the riser is not blocked, and the presence and/or amount of well fluids within the riser is monitored. Alternatively, the location of the point of contact or interface between oil and water within the riser is monitored. Based upon one or more of these determinations, the speed of the pump and flow rate from the containment vessel to the sump is adjusted.

Containment operations are preferably maintained until a relief well is successfully deployed and the well is sealed below the sea floor or another permanent solution to the leaking well head can be implemented. In certain embodiments, the containment system of the present invention may be used while still allowing access to the well through the riser, icy containment vessel and into the leaking well with conventional drill pipe. This is advantageous since the access can be used to pump additional chemicals and/or to deploy additional pumps into the containment vessel or to facilitate other work over operations.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
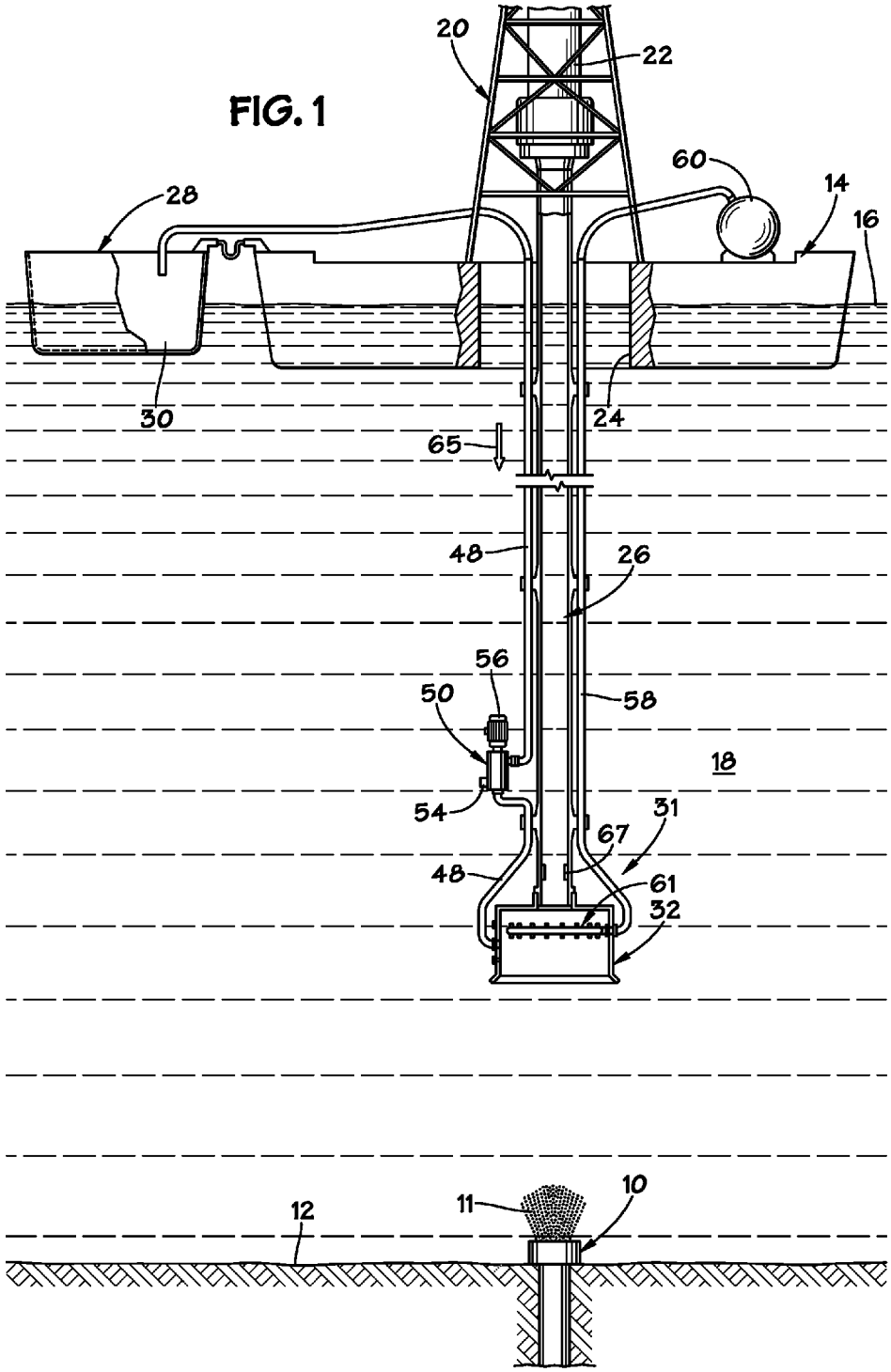
FIG. 1 is a side view of an exemplary temporary containment system constructed in accordance with the present invention.

FIG. 1 illustrates an exemplary wellhead 10 on the sea bed 12 which is leaking well fluids 11. A platform 14 is located at the surface 16 of the water 18 generally over the wellhead 10. The platform 14 may be a ship, jack up rig, a fixed platform or a floating platform or other types of platforms known in the art. The platform 14 carries a hoisting system 20, such as the Q4000 rig, which supports hoisting system 22. A moonpool 24 is formed within the platform, and a riser 26, which is supported by the hoisting system 20, extends downwardly through the moonpool 24. As is known, the riser 26 may be extended downwardly or raised upwardly through the moonpool 24 by the hoisting system 22. It is pointed out, that although a moonpool 24 is shown, embodiments of the invention may be practiced as well by extending the riser 26 downwardly or raising it upwardly, for example, over the side or stern of the platform 14. A distal fluid collection sump 28 is located in floating barge 30 or other floating vessel. Alternatively, the collection sump 28 may be located on the platform 14. It is noted that, while a collection sump is depicted, a number of other fluid handling systems might also be used for receipt of captured well fluids.

Figure 3:
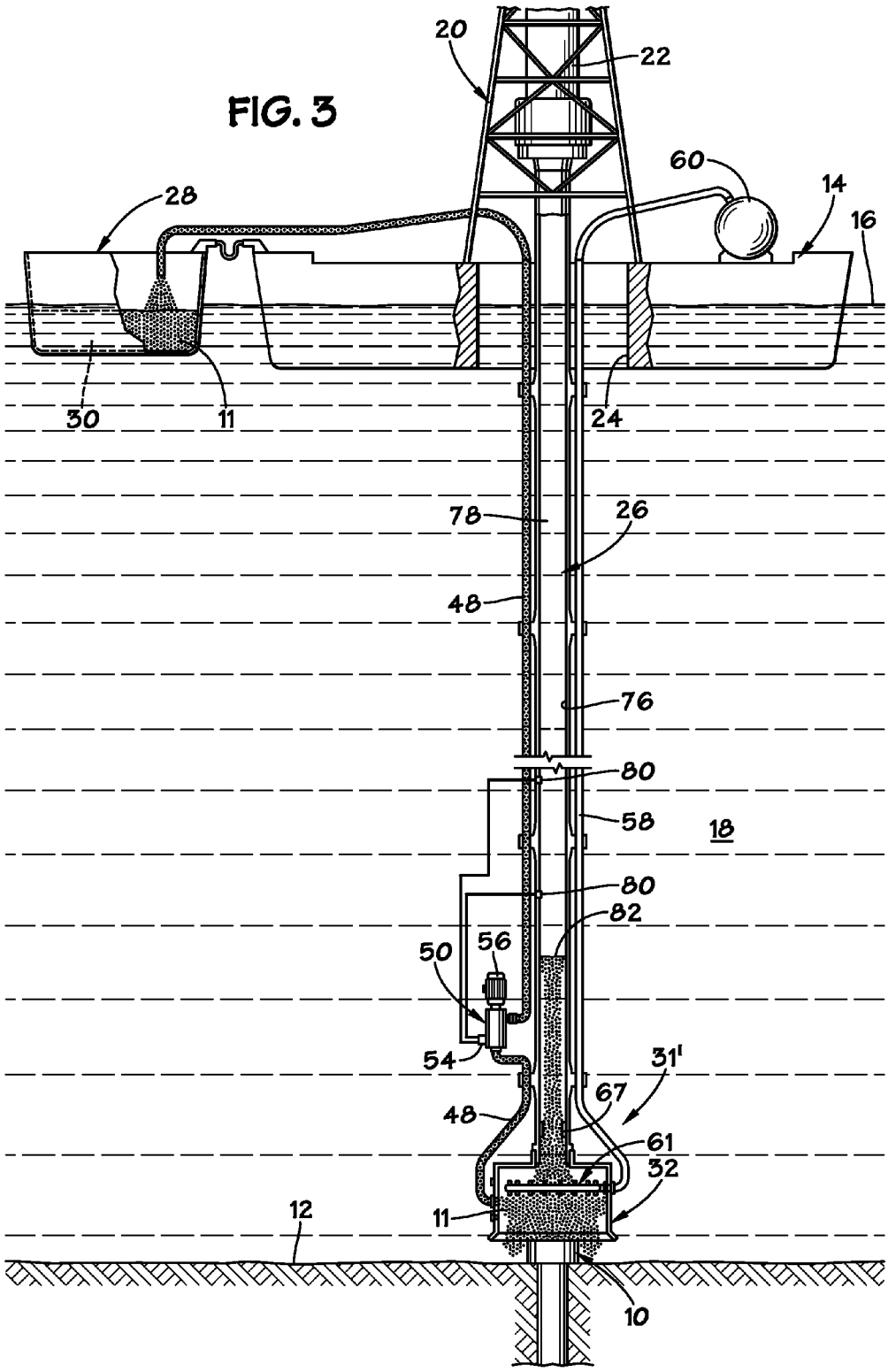
FIG. 3 is a side, cross-sectional view of an alternative embodiment for a temporary containment system.
Figure 4:
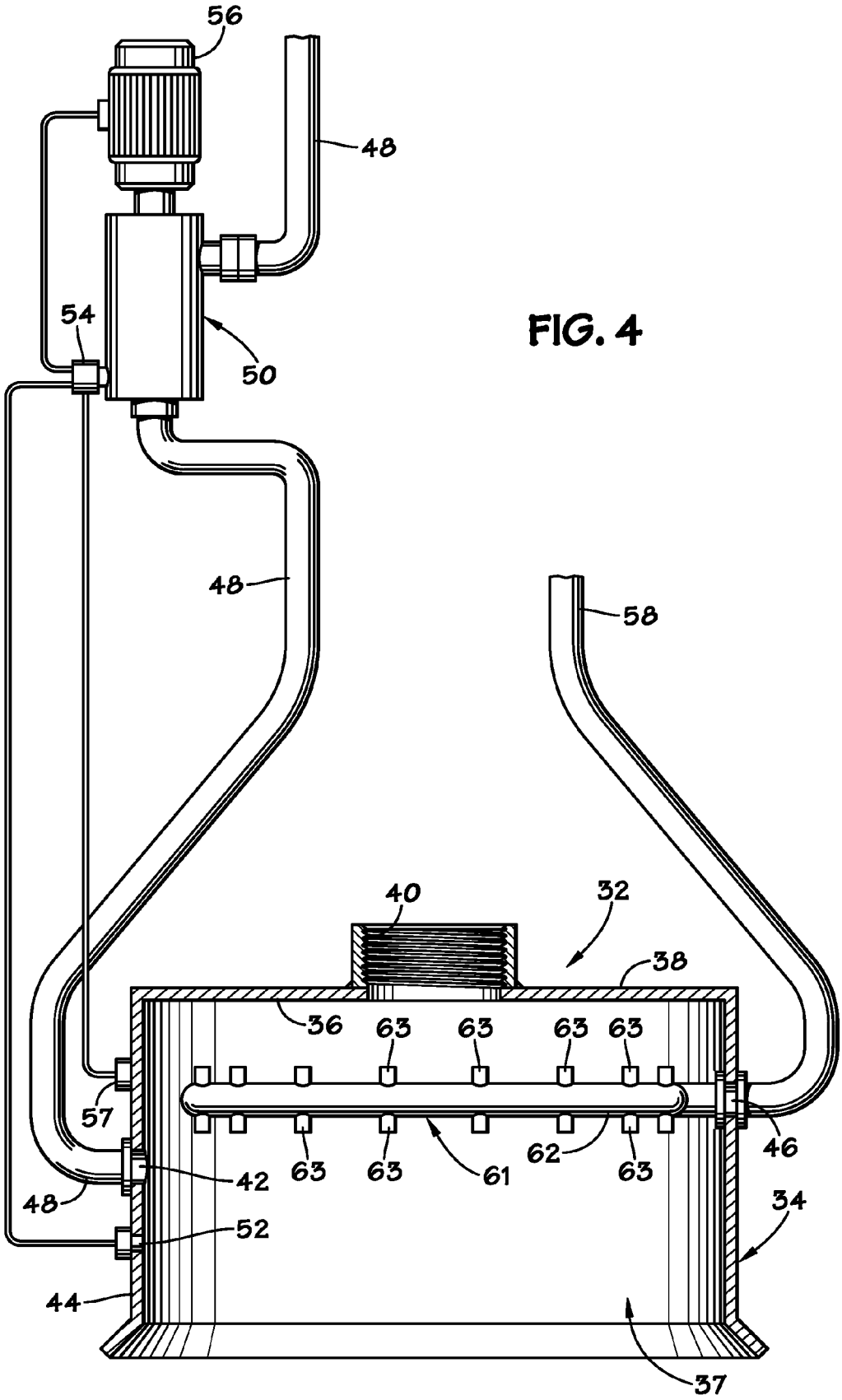
FIG. 4 is a detail drawing of an exemplary containment vessel and associated elements of the containment system shown in FIGS. 1, 2 and 3.

A containment system 31 in accordance with the present invention includes a containment vessel 32 is affixed to the lower end of the riser 26. An exemplary containment vessel 32 with associated components is depicted in greater detail in FIG. 3. As can be seen there, the containment vessel 32 features a housing 34 which encloses an interior chamber 36 and has an open lower end 37. The housing 34 is preferably formed of a suitable metallic material such as steel or cast from several types of suitable material, such as concrete. The upper end of the vessel 32 is enclosed by a top wall 38. A first opening 40 is disposed through the top wall 38. The first opening 40 is preferably threaded, or flanged in a manner known in the art, and shaped and sized to be affixed to the riser 26. Alternatively, attachment between the riser and first opening 40 may be made using is standard riser flanges, as is known in the art. A second opening 42 is disposed through the side wall 44 of the housing 34. A third opening 46 is also disposed through the side wall 44 of the housing 34. A first flow conduit 48 is essentially a fluid conduit that extends downwardly from the platform 14 and is affixed to the second opening 42. The upper end of the flow conduit 48 extends into the collection sump 28 or other fluid handling system. In current embodiments, the flow conduit 48 is made up of coiled tubing or jointed pipe. However, a number of other forms of conduits suitable for transmission of fluids can be used to form the flow conduit 48. Additionally, the first flow conduit 48 can be incorporated into the flow lines of the riser 26. FIG. 4 depicts in greater detail a section of the riser 26 which incorporates the flow conduit 48 into the choke line, of a type known in the art, of the riser 26 assembly. In addition, a fluid conduit 58, which will be described shortly, is incorporated into the choke or kill line for the riser 26 assembly. In this embodiment, flanges 49 are used to interconnect riser sections 26*a*, 26*b* and 26*c*. In addition, the flanges 49 also retain the flow conduit 48 and conduit 58.

A fluid pump 50 is incorporated into the flow conduit 48. In one embodiment, the pump 50 comprises a centrifugal pump with a variable speed motor and power supply. Depending upon the output of the leaking wellhead 10, there may be more than one flow conduit 48 and pump 50. Pumps can be exchanged by ROV and by cable deployment. Additionally, the size of the flow conduit 48 and the capacity of the pump 50 may be adjusted as necessary to handle the amount of leaking fluids from the wellhead 10. As can be seen in FIG. 3, a pressure sensor 52 extends into the interior chamber 36 and is useful to monitor fluid pressure within the chamber 36 (PWAS). The pressure sensor 52 is operably interconnected with a controller 54. The controller 54 includes a programmable processor of a type known in the art. The controller 54 is operably associated with a variable frequency (speed) drive and motor 56 which, in turn, is operably associated with the pump 50. The variable frequency drive and motor 56 can be incorporated into the pump 50. Alternatively, the variable frequency drive and motor 56 and related controls and components may be physically located on the platform 14 and not submerged while the pump is sub sea. A second pressure sensor 57 is mounted on the exterior surface of the vessel 32 and is adapted to measure the pressure outside of the vessel 32 (i.e., approximate pressure at the sea bed 12). The second pressure sensor 57 is operably interconnected with the controller 54 to provide a signal to the controller 54 that is indicative of the detected sea bed pressure. Alternatively, approximate sea bed pressure can be calculated based upon the depth of the well head 10 and programmed into the controller 54. It is also noted that the controller 54 be provided with control override by operators from the platform 14.

Figure 4A:
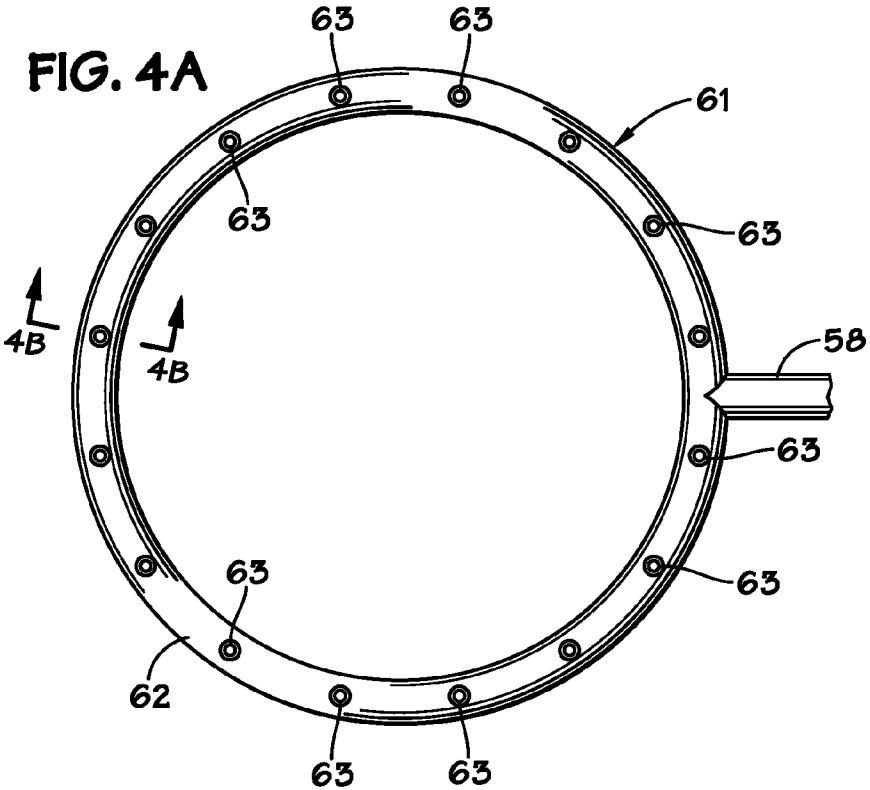
FIG. 4A is a detail drawing depicting components of an exemplary chemical distribution arrangement used with the containment system of FIG. 4.
Figure 4B:
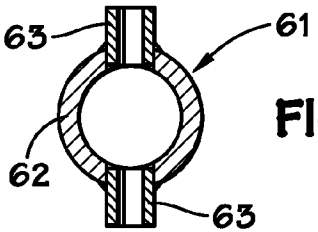
FIG. 4B is a cross-sectional view taken along lines B-B in FIG. 4A.
Figure 5:
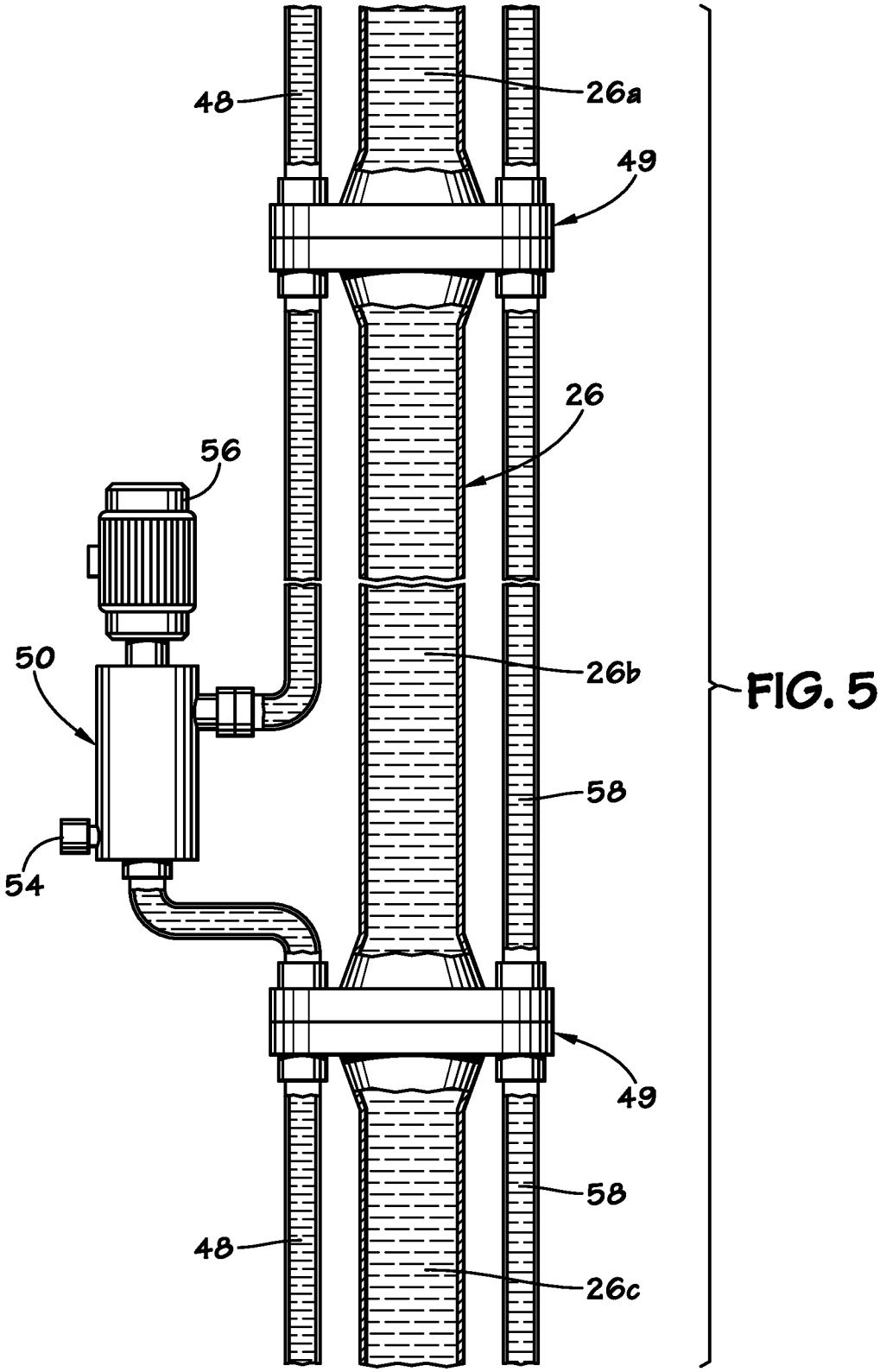
FIG. 5 is an enlarged side view of a portion of the containment system shown in FIGS. 1-3.

A second flow conduit 58 extends from chemical tank 60 on the platform 14 to the third opening 46 of the containment vessel 32. The chemical tank 60 is supplied with a pump, as is known in the art, for flowing chemicals from the tank 60 to the interior chamber 36 of the containment vessel 32. In one embodiment, the tank 60 contains one or more chemicals that prevent the formation of undesirable solids, such as solid hydrates and to scales, within the interior chamber 36. Suitable chemicals for this application include methanol. In an embodiment, a fluid distributing ring header 61 is located within the containment vessel 32 and is interconnected to the second flow conduit 58. An exemplary ring header 61 is depicted in FIGS. 4A and 4B apart from the other components of the containment system 31. The exemplary ring header 61 includes a hollow tubular ring 62 with a plurality of nozzles 63 that will transmit chemical fluids axially outwardly from the ring 62. In the depicted embodiments, the interior circumference of the ring 62 is sufficiently large to extend easily around the well head 10 without interference and to allow running of other tools through the riser 22. In operation, chemical fluid is flowed through the second flow conduit 58, into the ring 62 and outward through the nozzles 63. The ring 62 permits the fluids to be effectively distributed in a relatively even manner within the interior volume of the interior chamber 36.

Figure 2:
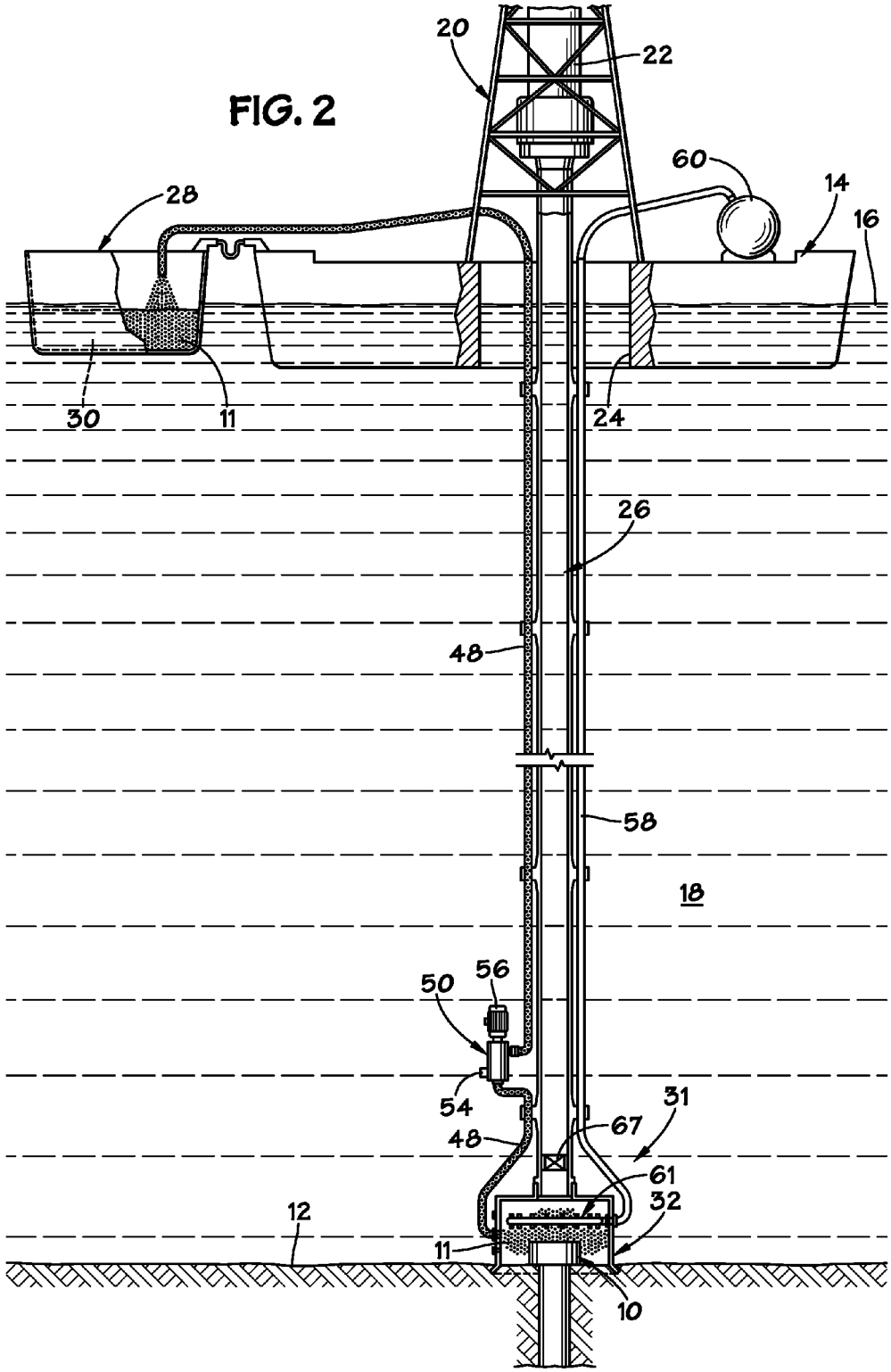
FIG. 2 is a side view of the temporary containment system of FIG. 1, now having been disposed proximate a subsea wellhead.

According to one method of operation, the containment system 31 is assembled by affixing the containment vessel 32 to the riser 26 at the platform 14. In addition, the flow conduit 48 and fluid conduit 58 are preferably interconnected with the containment vessel 32 at the platform 14. The hoisting system 22 then extends the riser 26 downwardly through the moonpool 24 in the direction indicated by the arrow 65 in FIG. 1. As the containment vessel 32 is brought into proximity with the wellhead 10, as depicted in FIG. 2, a blocking valve 67 within the riser 26 is closed to prevent flow of well fluids 11 upwardly through the riser 26. The blocking valve 67 may be in the form of a standard safety valve or blow out preventer, of a type known in the art. Other suitable valves that are capable of closing off flow within the riser 26 may be used as well. If pressures from the well head 10 are sufficiently high, the escaping well fluids might flow up through the riser 26 toward the to platform 14 in an uncontrolled and perhaps dangerous manner. It may be desired to close the valve 67 when the containment vessel 32 is proximate the sea bed 12 since this will permit pressures to equalize between the interior of the riser 26 and the surrounding water 18. The pump 50 is actuated to flow well fluids 11 through the first flow conduit 48 and into the containment sump 28. Since the escaping well fluids 11 are generally lighter than the surrounding sea water 18, they will generally travel toward the surface 16 without the need for high pump pressure in the flow conduit 48. Pump delta pressure is used to offset flow conduit 48 friction losses, so the pump 50 is essentially used to balance out frictional losses of flow through the flow conduit 48. Because the flow conduit 48 enters the containment vessel 32 through a side wall 44, well fluids 11 are removed from the interior chamber 36 laterally rather than through the riser 26.

It is noted that the containment vessel 32 is not intended to fully cap off the well head 10 or even to necessarily fully enclose the well head 10. Rather, it is intended that the vessel 32 be brought proximate the wellhead 10 so that leaking well fluids 11 which are escaping the well head 10 will be drawn by the pump 50 into the interior chamber 36 of the vessel 32 and via the flow conduit 48 to the sump 28. The open lower end 37 of the vessel 32 does not form a seal against the well head 10. The opening 37 is typically large enough so that there is significant spacing between the well head 10 and the vessel 32. However, the containment vessel 32 may be moved downwardly to the point that the lower end 37 will be pushed into an sealed with the mud line of the sea bed 12, as depicted in FIG. 2. Because a complete seal between the containment vessel 32 and the well head 10 is not provided, this step will minimize the amount of sea water that is permitted to enter the interior chamber 36 and thereby limit the formation of undesirable solid hydrates.

According to one method of operation, the controller 54 controls the pump 50 to maintain the pump suction pressure at a set point that is at a predetermined level above, at or below sea bed pressure. The controller 54 is programmed to compare the suction pressure (PWAS) detected by the sensor 52 with the set point, thereby enabling control of flowing pressure. Exemplary set points are those that are generally about 5-10% below the is sea bed pressure. However, the actual amount of difference below or above sea bed pressure can be optimized to minimize the amount of surrounding sea water intake through the opening between the well head 10 and the containment vessel's open end 37. The set point should not be too far below sea bed pressure, which could encourage sea water to flow into the chamber 36, or too far above sea bed pressure, which could encourage well fluids 11 to flow out of the chamber 36 into the surrounding sea 18.

Figure 6:
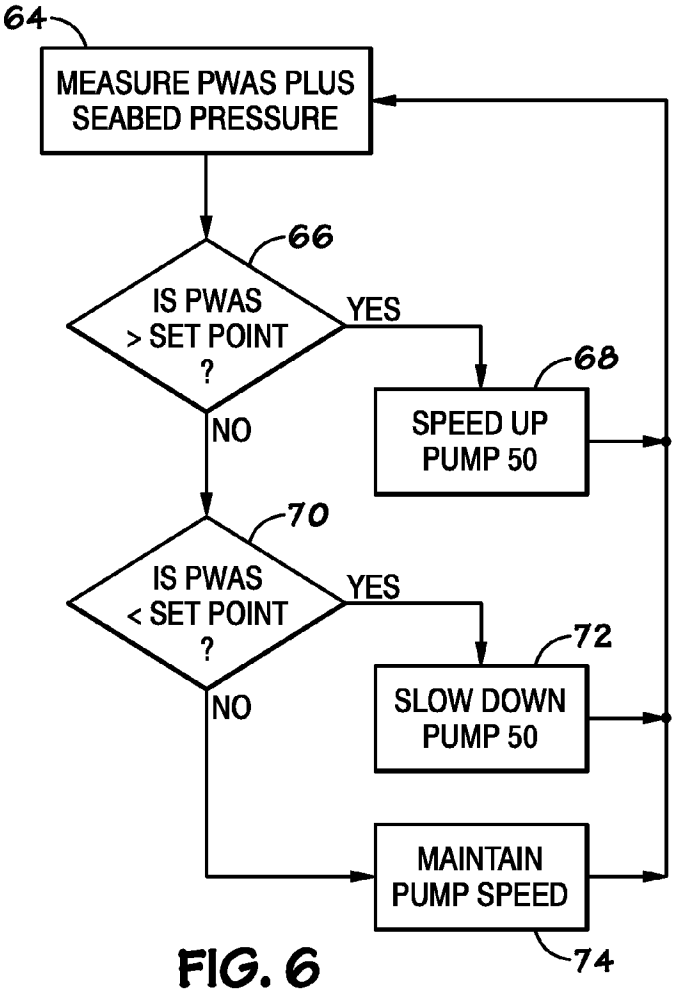
FIG. 6 is a schematic diagram of a control scheme used with the temporary containment arrangement of FIGS. 1-2.

FIG. 6 depicts an exemplary algorithm that could be employed by the controller 54 to provide closed-loop control of the variable frequency drive and motor 56 and pump 50. In step 64, the controller 54 obtains pressure measurements from the sensors 52 and 57. In decision step 66, the controller 54 determines whether the PWAS as measured by the sensor 52 is above the set point (as determined by the measured or calculated sea bed pressure). If the PWAS is above the set point, the controller 54 commands the drive 56 to increase the speed of the pump 50 (step 68). If the PWAS is not above the set point, the controller 54 then determines whether the PWAS is below the set point (step 70). If it is, the controller 54 commands the drive 56 to decrease the pump speed (step 72). If it is not, the controller 54 does not take any action, and the speed of the pump 50 is maintained (step 74). These operations are repeated in an iterative, closed loop manner so that the end result is to maintain the PWAS provided by the pump 50 at or near the set point. In the event, however, that an override command is provided to the controller 54 from an operator at the platform 14 to increase or decrease pump speed, the iteration is interrupted, and the controller 54 increases or decreases the speed of the pump 50 in accordance with the override command. Additionally, an operator might define and input a new set point for the system and permit the iterations to continue to balance about the new set point.

Referring now to FIG. 3, an alternative embodiment of the invention is depicted. The containment system 31' includes a riser 26 that defines a central flowbore 76 that is typically filled with sea water 78. In this embodiment, the riser 26 is not closed off by a blocking valve 67. Therefore, this embodiment of the invention is most suitable for instances wherein the well head 10 is not volatile and does not have well fluids 11 escaping at great pressures. However, it is preferred that a blocking valve 67 still be incorporated into the riser 26 to shut off flow through the riser 26 in the event of an emergency. As the containment vessel 32 is placed proximate the well head 10 and well fluids 11 are drawn by the pump 50 into the vessel 32, a portion of the well fluids 11 will enter the flowbore 76. In accordance with one method of operation, one or more sensors 80 (two shown) are disposed within the flowbore 76 and is operably associated with the controller 54. The sensor 80 may be a sensor that is capable of detecting the presence of well fluids 11 in the column of water 78 in the flowbore 76 via fluid density or flow characteristics or merely the presence of hydrocarbons. The sensors 80 may also comprise resistivity/conductivity sensors, of a type known in the art. Alternatively, a sensor 80 may be an optical sensor (i.e., a camera with suitable illumination) which is interconnected with suitable display means at the platform 14 via wired or wireless connection. The optical sensor may be used by an operator to determine visually whether well fluids are present in the flow bore 76 and it) the amount of such fluids. It is noted that, while only two sensors 80 are depicted in FIG. 2, there may, in fact, be a number of additional sensors 80 deployed along a portion of the length of the flow bore 76. The use of multiple sensors 80 will permit operators to determine the location of well fluids 11 within the riser 26. Alternatively, a head pressure sensor may be used. Typically, the well fluids 11 and sea water 78 within the riser 26 will meet at an interface 82 (FIG. 2). The multiple sensors 80 may be used to determine the location of the interface 82 within the riser 26. If the interface 82 is at a level that is too high within the riser 26, the speed of the pump 50 may be increased by overriding the controller 54 to flow a greater amount of well fluid 11 out of the vessel 32 and toward the sump 28. This technique for control of the pump 50 may be used in place of or in addition to the use of controlling PWAS based upon sea bed pressure.

In yet another embodiment of the invention, operators aboard the platform 14 visually examine any fluids leaving the riser 26 of FIG. 3 near the surface to determine whether well fluids 11 have reached the surface 16. If so, the controller 54 is commanded from the platform 14 to increase the speed of the pump 50 and flow additional well fluids 11 to the sump 28.

In instances where the well head 10 is very deep, ice crystals and solid hydrates tend to form. In order to prevent such solids from forming within the interior chamber 36, chemicals are flowed from the tank 60 via conduit 58 to the chamber 36 during a containment operation as described previously. As noted previously, the distribution ring header 61 is useful to ensure relatively consistent distribution of chemicals from tank 60 within the chamber 36.

The containment systems 31 and 31' are typically to be operated as described previously on a temporary basis until a more permanent solution to the leaking well head 10 can be implemented, such as a relief well completed.

It is pointed out that the containment system 31' (FIG. 3) of the present invention can typically be used to contain the leaking well fluids 11 while still permitting access through the riser 26 and containment vessel 32 into the well head 10. This feature is advantageous since it permits access to the well while maintaining PWAS and pumping out the leaking well fluids 11. In this regard, drill pipe (either jointed pipe or coiled tubing) can be disposed downward through the riser 26 and used to perform additional tasks, such as pumping additional chemicals into the vessel 32 or to deploy additional fluid pumps (if needed) into the vessel 32. Alternatively, access through the riser 26 may be used to conduct well work over or other operations The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A system for containing leaking well fluids from a subsea well head, the system comprising:
- a containment vessel defining an interior chamber and having an open lower end, the containment vessel to be placed proximate a leaking well head to receive well fluids leaking from the well head within the chamber;
- the containment vessel having a first opening for attachment of the vessel to a riser;
- a second opening disposed through a side wall of the containment vessel;
- a first flow conduit extending through the second opening from the interior chamber to a collection sump for well fluids;
- a pump for flowing well fluids from the interior chamber along the flow conduit and to a collection sump.

2. The system of claim 1 wherein the pump is a variable speed pump and further comprising a controller for controlling the speed of the pump.

3. The system of claim 2 further comprising a pressure sensor for detecting fluid pressure within the interior chamber and providing a signal indicative of the detected pressure to the controller, and
- wherein the controller compares the detected pressure within the interior chamber to an approximate pressure at sea bed and adjusts the speed of the pump toward a set point that is based upon the sea bed pressure.

4. The system of claim 2 wherein the speed of the pump is adjusted based upon the presence of well fluids within the riser.

5. The system of claim 1 further comprising:
- a supply of chemical for inhibiting the formation of hydrates within the interior chamber; and
- a second flow conduit operably interconnected with the supply of chemicals to deliver said chemicals to the chamber.

6. The system of claim 5 further comprising a fluid distributing ring header interconnected with the second flow conduit to distribute the chemicals within the chamber.

7. The system of claim 1 wherein the containment vessel is operably associated with a riser that is extended downwardly from a surface platform to place the containment vessel proximate the well head.

8. The system of claim 7 wherein:
- the riser has a flow bore defined along its length; and
- wherein the flow bore of the riser is closed by a valve.

9. The system of claim 1 wherein there is a gap between the open lower end of the containment vessel and the well head.

10. The system of claim 9 wherein the containment vessel is sealed into a sea bed mud line.

11. A method of containing a leak of well fluid from a subsea well head comprising the steps of:
- disposing a containment vessel in proximity to the well head by a riser that is lowered from a platform, the riser having a flow bore defined along its length, the containment vessel defining an interior chamber;
- closing the flow bore of the riser with a valve;
- drawing leaking well fluid into the interior chamber; and
- thereafter, actuating a pump to flow said well fluid from the chamber through a side wall of the containment vessel and to a collection sump.

12. The method of claim 11 further comprising the step of flowing a chemical into the interior chamber to inhibit the formation of solids.

13. The method of claim 11 wherein the pump is a variable speed pump and wherein the speed of the pump is controlled to vary the amount of flow from the chamber to the sump.

14. The method of claim 13 further comprising the steps of:
- determining a pressure within the interior chamber;
- determining an approximate sea bed pressure; and
- controlling the speed of the pump to maintain the pressure within the interior chamber toward a set point that is based upon the determined sea bed pressure.

15. The method of claim 14 wherein the approximate sea bed pressure is determined by a sensor.

16. The method of claim 14 wherein the approximate sea bed pressure is determined by calculation based upon well head depth.

17. The method of claim 13 wherein:
- the containment vessel is disposed in proximity to the well head by a riser that is lowered from a platform, the riser having a central flow bore defined along its length;
- examining the flowbore of the riser for the presence of well fluids within; and
- adjusting the speed of the pump based upon the presence of well fluids within the riser.

18. The method of claim 17 wherein the step of examining the flowbore of the riser for the presence of well bore fluids comprises observing fluids exiting the riser proximate the surface for the presence of well fluids.

19. The method of claim 17 wherein the step of examining the flowbore of the riser for the presence of well bore fluids comprises observing the flowbore of the riser with at least one camera.

20. The method of claim 17 wherein the step of examining the flowbore of the riser for the presence of well bore fluids comprises detecting well fluids with at least one sensor within the riser.

21. The method of claim 11 wherein the containment vessel is brought into proximity to, but not in contact with, the well head.

22. The method of claim 21 wherein the containment vessel is sealed into a sea bed mud line.

23. A method of containing a leak of well fluid from a subsea well head comprising the steps of:

disposing a containment vessel in proximity to the well head, the containment vessel defining an interior chamber with an open lower end;

drawing leaking well fluid through the open lower end into the interior chamber;

thereafter, flowing said well fluid from the chamber to a distal sump along a flow conduit under impetus of a fluid pump;

determining a pressure within the interior chamber;

determining an approximate sea bed pressure; and controlling the speed of the pump to maintain the pressure within the interior chamber toward a set point that is based upon the determined sea bed pressure.

24. The method of claim 23 further comprising the step of flowing a chemical into the interior chamber to prevent the formation of solid hydrates within the chamber.

25. A method of containing a leak of well fluid from a subsea well head comprising the steps of:

disposing a riser defining a flowbore and having an affixed containment vessel in proximity to the well head, the containment vessel defining an interior chamber with an open lower end;

drawing leaking well fluid through the open lower end into the interior chamber:

thereafter, flowing said well fluid from the chamber to a distal sump along a flow conduit under impetus of a fluid pump;

examining the flowbore of the riser for the presence of well fluids within; and adjusting the speed of the pump based upon the presence of well fluids within the riser.

26. The method of claim 25 wherein the step of examining the flowbore of the riser for the presence of well bore fluids comprises observing fluids exiting the riser proximate the surface for the presence of well fluids.

27. The method of claim 25 wherein the step of examining the flowbore of the riser for the presence of well bore fluids comprises observing the flowbore of the riser with at least one camera.

28. The method of claim 25 wherein the step of examining the flowbore of the riser for the presence of well bore fluids comprises detecting well fluids with at least one sensor within the riser.

* * * * *